United States Patent [19]

Siegel

[11] Patent Number: 4,765,664

[45] Date of Patent: Aug. 23, 1988

[54] ANCHOR LOCK

[76] Inventor: Myron Siegel, 29 Lexington Ave., Brooklyn, N.Y. 11238

[21] Appl. No.: 36,365

[22] Filed: Apr. 8, 1987

[51] Int. Cl.[4] ..... E05C 19/18

[52] U.S. Cl. ..... 292/288; 292/DIG. 15; 292/DIG. 36

[58] Field of Search ..... 292/DIG. 15, DIG. 36, 292/57, 281, 285, 288

[56] References Cited

U.S. PATENT DOCUMENTS

| | | | |
|---|---|---|---|
| 238,010 | 2/1881 | Thomson | 292/281 |
| 1,508,029 | 9/1924 | Segal | 292/57 |
| 1,622,791 | 3/1927 | Lang | 292/57 X |
| 2,443,279 | 6/1948 | Sugg | 292/57 |
| 3,961,816 | 6/1976 | Mueller | 292/288 X |
| 4,178,024 | 12/1979 | Wagner | 292/57 |
| 4,418,550 | 12/1983 | Hamilton | 292/281 X |
| 4,462,623 | 7/1984 | Grant | 292/DIG. 15 X |

*Primary Examiner*—Richard E. Moore

*Attorney, Agent, or Firm*—Richard L. Miller

[57] ABSTRACT

This anchor lock is designed to prevent a door or cover of a doorway from being forced inward. Primarily, it consists of a sleeve anchorable in pavement in front of the door, and a bar with a tongue at its top end is received in the sleeve, and the tongue is received in a plate attached to the door. The bar is also provided with a projecting pin for preventing its removal from the sleeve when the device is in use, and a slot in the sleeve enables the pin to travel upward and outward of the sleeve, enabling storage of the bar when the device is not in use.

4 Claims, 1 Drawing Sheet

ANCHOR LOCK

BACKGROUND OF THE INVENTION

The instant invention relates generally to security devices, and more specifically to an anchor lock.

Numerous anchor locks have been provided in the prior art that are adapted to various applications. While these units may be suitable for the particular purpose to which they address, they would not be as suitable for the purpose of the present invention as hereafter described.

SUMMARY OF THE INVENTION

A primary object of the present invention is to provide an anchor lock that will overcome the shortcomings of the prior art devices.

Another object is to provide an anchor lock, which will be unique, in that it will be employed to prevent the pushing in of pull-down security covers in entrances of store fronts and the like.

An additional object is to provide an anchor lock, which will be so designed, as to be mounted fixedly in the ground and will engage a security cover.

A further object is to provide an anchor lock that is simple and easy to use.

A still further object is to provide an anchor lock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
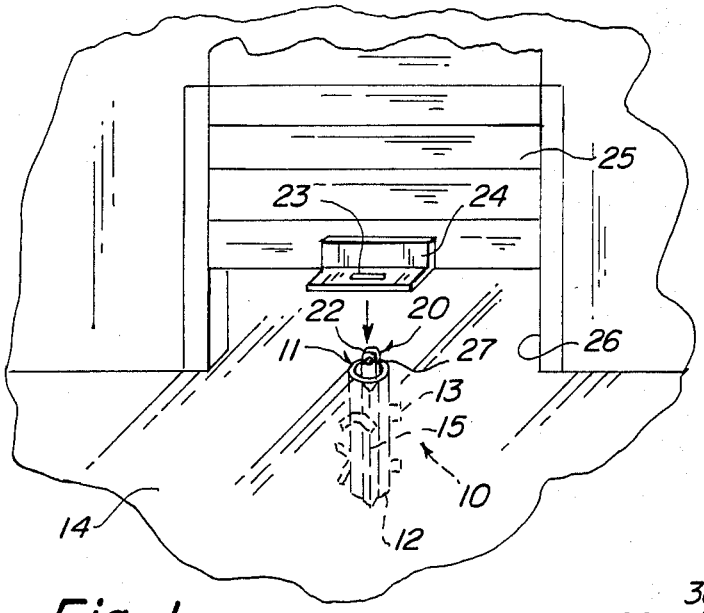
FIG. 1 is a perspective view of the present invention, shown in operative use.
Figure 3:
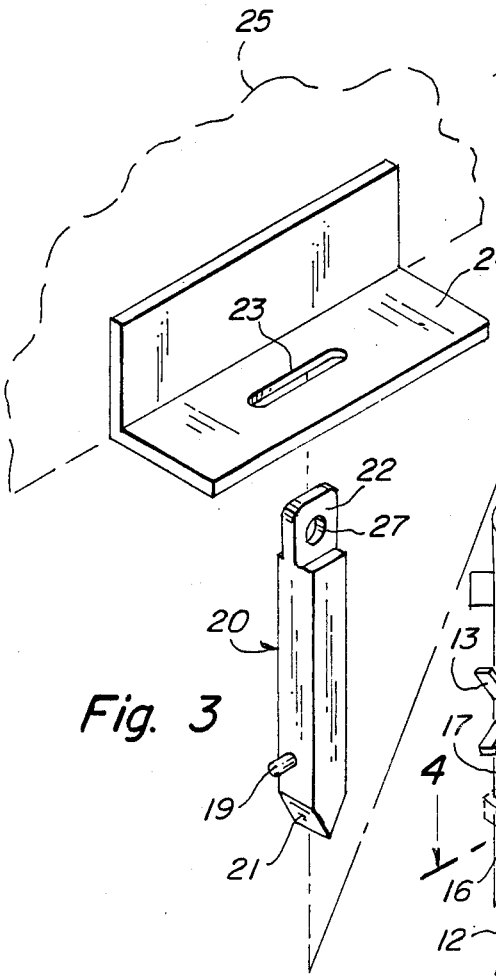
FIG. 3 is an enlarged exploded perspective view of the embodiment of FIG. 1, illustrating the cover or door in phantom and fragmentary.
Figure 4:
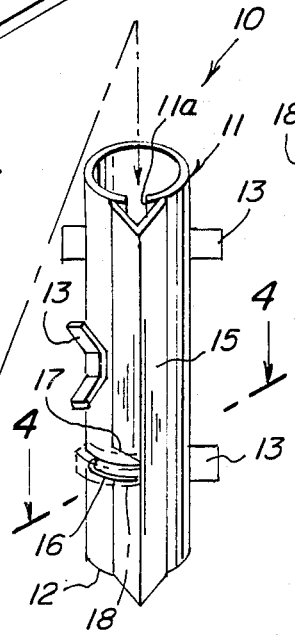
FIG. 4 is and enlarged cross-sectional view, taken along the line 4—4 of FIG. 3.
Figure 4:
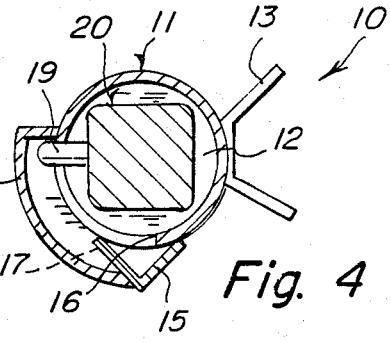

Turning now descriptively to the drawings, in which like reference characters denote like elements throughout the several views, FIGS. 1, 3 and 4 illustrates a lock 10 that is shown to include a cylindrical sleeve 11 having a bottom wall 12 fixedly secured thereto, by means of welding (not shown). Extending tabs 13 are spaced apart and also fixedly secured to the outer periphery or sleeve 11, for anchoring 11 within concrete pavement 14, and a vertical opening 11*a* is provided through sleeve 11, for a purpose which hereinafter will be described. The longitudinal edges of a channel 15 are also fixedly secured adjacent to the edges defining the opening 11*a* through the outer periphery of sleeve 11, and a horizontal cut-out opening 16 intersects with opening

11*a* of sleeve 11 and a similar cut-out opening 17 provided in a leg portion of channel 15. An arcuately formed guard member 18 is suitably fixedly secured to both the outer periphery of sleeve 11 and to channel 15 over its opening 17, so as to provide prevention against anchoring cement entering sleeve 11 and channel 15 when installing lock 10 within the concrete pavement 14.

Figure 2:
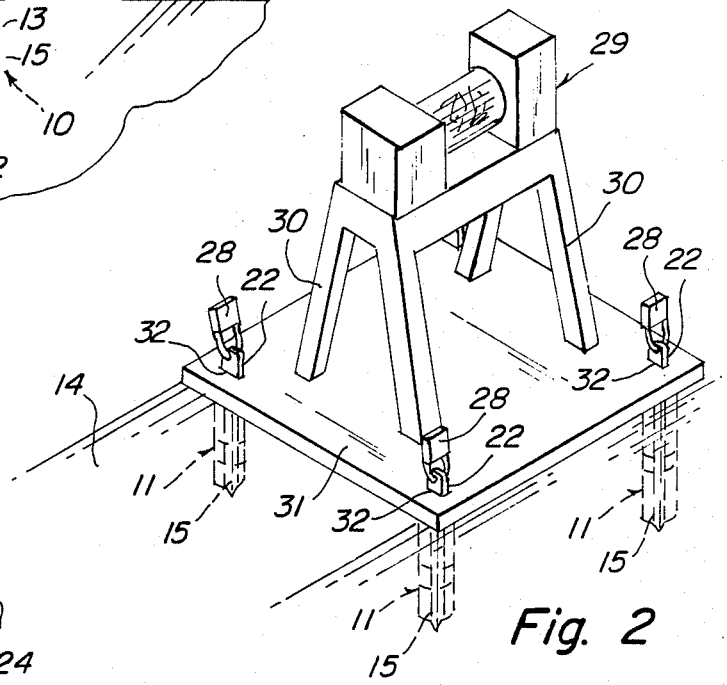
FIG. 2 is a perspective view of the invention, shown in use for preventing the theft of a machine.

A projecting pin 19 is fixedly secured to an outside surface of a bar 20 that is received within sleeve 11, and the bottom end 21 of bar 20 is pointed for being easily entered into the top of sleeve 11. A projecting tongue 22 is integrally attached to the top of bar 20 and is freely received within an elongated opening through one side of a plate 24 that is rigidly secured in a suitable manner, to the bottom outside surface of door or cover 25 elevatable in doorway 26 of a storefront, garage, or the like. Tongue 22 is also provided with an opening 27 therethrough, for receiving a suitable pad lock 28 as illustrated in FIG. 2. Bar 20 is designed to lock in place within sleeve 11, by being rotated approximately ninety degrees in the sleeve 11. The horizontal opening 16 traverses approximately a 90° circumferential arc in sleeve 11, enabling pin 19 to travel to the end of the opening 16 that is away from opening 11*a*, and thus, the top edge of the horizontal opening 16 prevents upward travel of bar 20 when its tongue 22 is locked in plate 24 by the pad lock 28.

In use, the bar 20 which may be removed and stored with the pad lock 28, is placed in the sleeve 11 with the tongue 22 upward. Bar 20 is then pushed downward with the pin 19 riding in the opening 11*a*, until pin 19 reaches the horizontal opening 16. After the above, the bar 20 is rotated clock-wise until pin 19 is stopped at the end of the opening 16, and when this occurs, the tongue 22 will be in alignment with the opening 23 in the plate 24 of the door or cover 25. The door or cover 13 is then pulled fully downward until the tongue 22 is fully entered into the opening 23 of the plate 24, after which the pad lock 28 is placed in the opening 27 and locked, thus securing the door or cover 25.

Referring now to FIG. 2, lock 10 is employed in a similar manner, as was heretofore described, with the exception, that sleeves 11 are not employed in plurality by being embedded in pavement 14 in a spaced relationship. In this instance, a shop machine 29 or the like, is fixedly secured by its legs 30 to the top of a plate 31 that is provided with openings 32 that align with the respective tongues 22 of the plurality of lock 28.

In use, the plurality of locks 10 function in the same manner described of FIGS. 1, 3 and 4 the only exception being that they are employed as hold-down means for machine 29.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An anchor lock, comprising, a sleeve, for being anchored in pavement, a bar received in said sleeve, for engagement with and locking said lock to a door in a doorway, wherein said sleeve is provided with a plurality of spaced tabs for anchoring said sleeve in pavement and a bottom wall is fixedly secured to a bottom end of said sleeve, and a channel is fixedly secured by longitudinal edges to an outer periphery of said sleeve, adjacent to edges of a vertical opening provided through the length of said sleeve, and the vertical opening through said sleeve freely receives a projecting pin fixedly secured to a lower portion of said bar.

2. An anchor lock as set forth in claim 1, wherein said bar includes a tongue integrally attached to an upper end of said bar and said tongue is removably received in and opening provided in a plate fixedly secured on an outside surface of a door, and an opening through said tongue is provisioned to receive a padlock whereby said door is locked to said anchor lock.

3. An anchor lock as set forth in claim 2, wherein a horizontal opening is provided through said sleeve, extends ninety degrees of the circumference of said sleeve, and said pin when engaging with an end of the horizontal opening, prevents further travel of rotation of said bar in said sleeve, and an upper edge of the horizontal opening prevents forcing said bar and said door upward, because said pin engages with said upper edge of the horizontal opening when said door is locked by said padlock received in said tongue of said bar.

4. An anchor lock as set forth in claim 3, wherein a channel is fixedly secured to said outer periphery of said sleeve and over a cut-out opening through one leg of said channel, and prevents anchoring cement from entering said sleeve and said channel.

* * * * *